United States Patent [19]

Manaka et al.

[11] 4,215,656

[45] Aug. 5, 1980

[54] ELECTRONIC CLOSED LOOP AIR-FUEL RATIO CONTROL SYSTEM FOR USE WITH INTERNAL COMBUSTION ENGINE

[75] Inventors: Nobuzi Manaka, Yokosuka; Takeshi Fujishiro, Yokohama; Shigeo Aono, Seki; Akio Hosaka, Yokohama; Masaharu Asano; Mituhiko Ezoe, both of Yokosuka, all of Japan

[73] Assignee: Nissan Motor Company, Limited, Yokohama, Japan

[21] Appl. No.: 767,988

[22] Filed: Feb. 11, 1977

[30] Foreign Application Priority Data

Feb. 12, 1976 [JP] Japan ..... 51-13251

[51] Int. Cl.[2] ..... F02B 3/08; F02M 7/12

[52] U.S. Cl. ..... 123/489; 60/276; 60/285; 123/119 EC

[58] Field of Search ..... 123/119 R, 119 EC, 32 EE, 123/32 EA; 60/276, 285

[56] References Cited

U.S. PATENT DOCUMENTS

| | | | |
|---|---|---|---|
| 3,796,198 | 3/1974 | Mauch et al. | 123/32 EA |
| 3,812,830 | 5/1974 | Traisnel | 123/32 EA |
| 3,911,884 | 10/1975 | Moriya et al. | 123/119 EC |
| 3,915,135 | 10/1975 | Kushida et al. | 123/119 EC |
| 3,960,118 | 6/1976 | Konomi et al. | 60/276 |
| 3,961,477 | 6/1976 | Grieshaber et al. | 60/285 |
| 4,067,718 | 2/1977 | Laprade et al. | 60/285 |
| 4,068,472 | 1/1978 | Takata et al. | 60/276 |
| 4,089,313 | 5/1978 | Asano et al. | 123/32 EE |
| 4,109,615 | 8/1978 | Asano | 123/32 EE |
| 4,112,880 | 9/1978 | Asano et al. | 123/32 EE |
| 4,142,482 | 3/1979 | Asano et al. | 123/32 EE |

*Primary Examiner*—Stephen C. Bentley
*Assistant Examiner*—S. A. Cangialosi
*Attorney, Agent, or Firm*—Schwartz, Jeffery, Schwaab, Mack, Blumenthal & Koch

[57] ABSTRACT

A circuit is provided in an electronic closed loop air-fuel ratio control system for starting and terminating the operation of the system at different voltages from an exhaust gas sensor.

10 Claims, 6 Drawing Figures

ELECTRONIC CLOSED LOOP AIR-FUEL RATIO CONTROL SYSTEM FOR USE WITH INTERNAL COMBUSTION ENGINE

FIELD OF THE INVENTION

The present invention relates generally to an electronic closed loop air-fuel ratio control system for an internal combustion engine, and particularly to an improvement in such a system for optimally controlling an air-fuel mixture fed to the engine by changing a reference voltage for starting and terminating feedback control of the system at different voltage levels of an output of an exhaust gas sensor.

BACKGROUND OF THE INVENTION

Various systems have been proposed to supply an optimal air-fuel mixture to an internal combustion engine in accordance with the mode of engine operation, one of which is to utilize the concept of an electronic closed loop control system based on a sensed concentration of a component in exhaust gases of the engine.

According to the conventional system, an exhaust gase sensor, such as an oxygen analyzer, is deposited in an exhaust pipe for sensing a concentration of a component of exhaust gases from an internal combustion engine, generating an electrical signal representative of the sensed component. A differential signal generator is connected to the sensor for generating an electrical signal representative of a differential between the signal from the sensor and a reference signal. The reference signal is previously determined in due consideration of, for example, an optimum ratio of an air-fuel mixture to the engine for maximizing the efficiency of both the engine and an exhaust gas refining means. A so-called proportional-integral (p-i) controller is connected to the differential signal generator, receiving the signal therefrom. A pulse generator is connected to the p-i controller, generating a train of pulses which is fed to an air-fuel ratio regulating means, such as electromagnetic valves, for supplying an air-fuel mixture with an optimum air-fuel ratio to the engine.

In the previously described control system, a problem has been encountered that the output of the exhaust gas sensor falls to a considerable extent at a low ambient temperature, resulting in the fact that the feedback control of the system can be no longer carried out properly due to, for example, disturbance of external noises. In the above, the reason why the output of the sensor falls under such a condition is that internal impedance of the sensor rises with decrease of an ambient temperature. Furthermore, in general, at cold engine start, in order to secure good engine start and stable engine running operation, it is necessary to supply the engine with a rich air-fuel mixture. Such a rich mixture, however, can not be supplied to the engine at cold engine start through the feedback control. In order to remove this defect, it might be proposed by those skilled in the art that the system should be modified in a manner to start the feedback control when the output of the exhaust gas sensor exceeds a reference voltage, and, whilst, to terminate the feedback control when the output of the exhaust gas sensor falls below the above mentioned reference voltage.

However, in spite of the above proposal, another problem is encountered which results from the fact that the same reference voltage determines both the start and the termination of the feedback control. More specifically, after starting the engine, when the output of the exhaust gas sensor increases with warming up of the engine, it is desirable that the feedback control should be started as soon as possible. On the other hand, when the output of the exhaust gas sensor decreases with lowering of the engine temperature after stopping a vehicle, the feedback control, on the contrary, should be terminated as soon as possible. This is because the lowering of the output of the exhaust gas sensor makes the air-fuel mixture richer, resulting in air pollution due to noxious components in exhaust gases and lessening fuel economy. Therefore, it is understood that a reference voltage starting the feedback control should be less than that terminating the same.

It is therefore an object of the present invention to provide an improved electronic closed loop control system for removing the above described inherent defects of the prior art.

Another object of the present invention is to provide an improved electronic closed loop air-fuel ratio control system which changes a reference voltage in order to cause the feedback control to start or terminate at different voltage levels of the exhaust gas sensor's output.

BRIEF DESCRIPTION OF THE DRAWING

These and other objects, features and many of the attendant advantages of the present invention will be appreciated more readily as the invention becomes better understood by the following detailed description, taken with the accompanying drawings, wherein like parts in each of the several figures are identified by the same reference characters, and wherein.

DETAILED DESCRIPTION OF THE PREFERRED EMBODIMENTS

Figure 1:
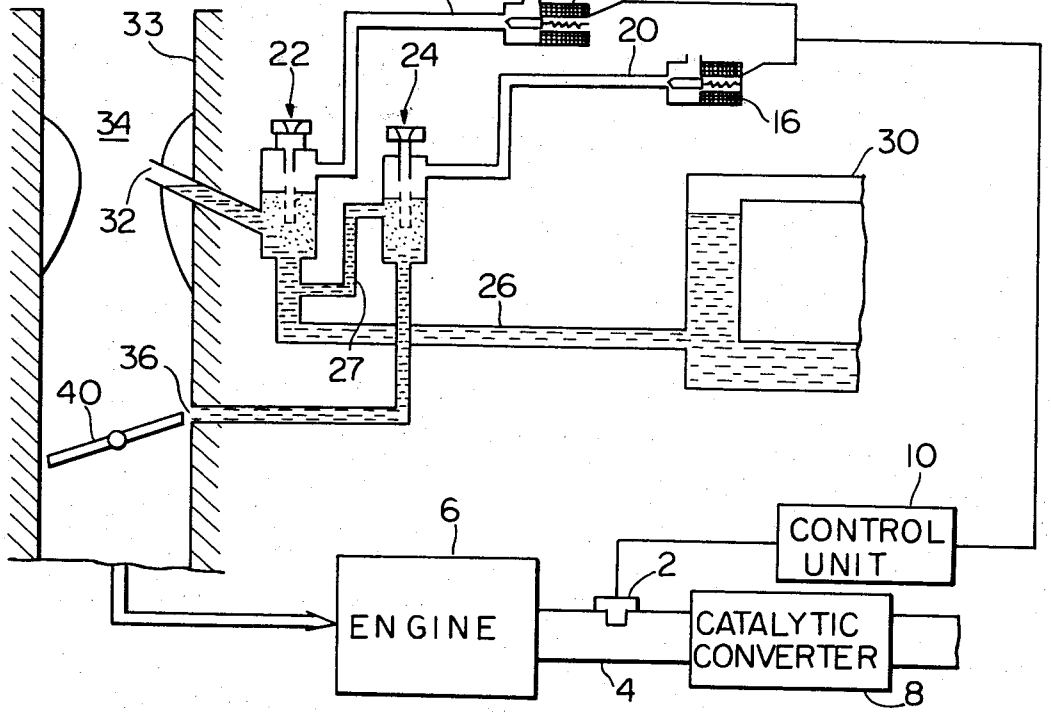
FIG. 1 schematically illustrates a conventional electronic closed loop air-fuel ratio control system for regulating the air-fuel ratio of the air-fuel mixture fed to an internal combustion engine.

Reference is now made to drawings, first to FIG. 1, which schematically exemplifies in a block diagram a conventional electronic closed loop control system with which the present invention is concerned. The purpose of the system of FIG. 1 is to electrically control the air-fuel ratio of an air-fuel mixture supplied to an internal combustion engine 6 through a carburetor (no numeral). An exhaust gas sensor 2, such as an oxygen, CO, HC, $NO_x$, or $CO_2$ analyzer, is disposed in an exhaust pipe 4 in order to sense the concentration of a component in exhaust gases. An electrical signal from the exhaust gas sensor 2 is fed to a control unit 10, in which the signal is compared with a reference signal to generate a signal representing a differential therebetween. The magnitude of the reference signal is previously determined in due consideration of an optimum air-fuel ratio of the air-fuel mixture supplied to the engine 6 for maximizing the efficiency of a catalytic converter 8. The control unit 10, then, generates a command signal, or in other words, a train of command pulses based on the signal representative of the optimum air-fuel ratio. The command signal is employed to operate two electromagnetic valves 14 and 16. The control unit 10 will be described in more detail in conjunction with FIG. 2.

The electromagnetic valve 14 is provided in an air passage 18, which terminates at one end thereof at an air bleed chamber 22, to control the rate of air flowing into the air bleed chamber 22 in response to the command pulses from the control unit 10. The air bleed chamber 22 is connected to a fuel passage 26 for mixing air with fuel delivered from a float bowl 30, supplying the air-fuel mixture to a venturi 34 through a discharging (or main) nozzle 32. Whilst, the other electromagnetic valve 16 is provided in another air passage 20, which terminates at one end thereof at another air bleed chamber 24, to control a rate of air flowing into the air bleed chamber 24 in response to the command pulses from the control unit 10. The air bleed chamber 24 is connected to the fuel passage 26 through a fuel branch passage 27 for mixing air with fuel the float bowl 30, supplying the air-fuel mixture to an intake passage 33 through a low speed nozzle 36 adjacent to a throttle 40. As shown, the catalytic converter 8 is provided in the exhaust pipe 4 downstream of the exhaust gas sensor 2. In this case, for example, the electronic closed loop control system is designed to set the air-fuel ratio of the air-fuel mixture to about stoichiometry. This is because the three-way catalytic converter is able to simultaneously and most effectively reduce nitrogen oxides ($NO_x$), carbon-monoxide (CO), and hydrocarbons (HC), only when the air-fuel mixture ratio is set at about stoichiometry. It is apparent, on the other hand, that, when other catalytic converter such as an oxidizing or deoxidizing type is employed, case by case setting of an air-fuel mixture ratio, which is different from the above, will be required for effective reduction of noxious components.

Figure 2:
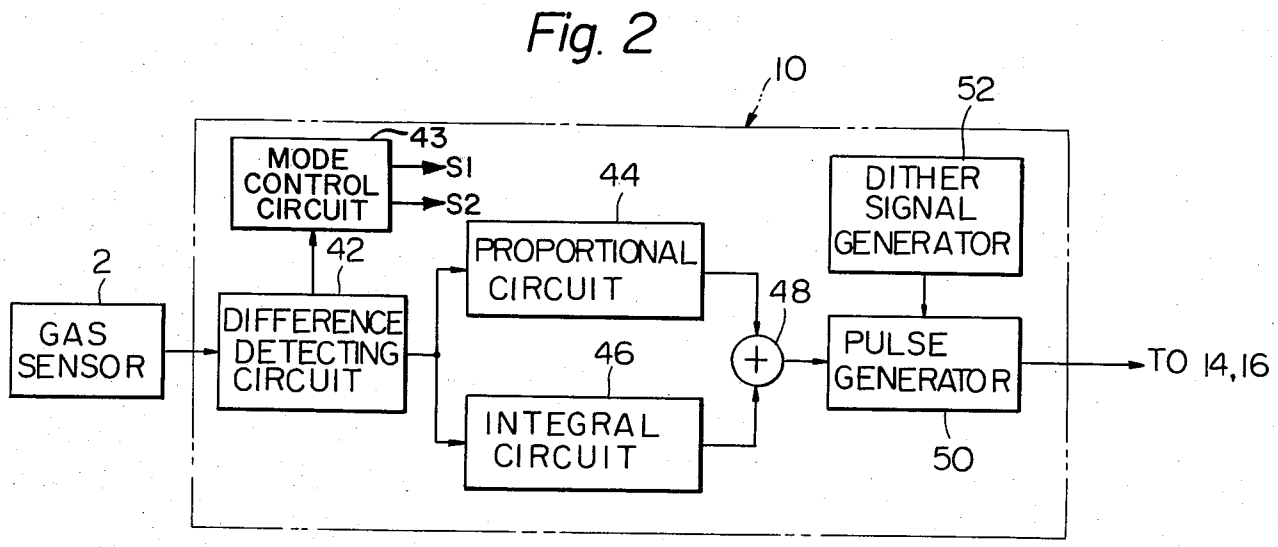
FIG. 2 is a detailed block diagram of an element of the system of FIG. 1.

Reference is now made to FIG. 2, in which somewhat detailed arrangement of the control unit 10 is schematically exemplified. The signal from the exhaust gas sensor 2 is fed to a difference detecting circuit 42 of the control unit 10, which circuit compares the input signal with a reference voltage to generate a differential signal. The signal from the difference detecting circuit 42 is then fed to two circuits, viz., a proportional circuit 44 and an integration circuit 46. The purpose of the provision of the proportional and the integration circuits 44 and 46 is, as is well known to those skilled in the art, to increase both a response characteristic and stability of the system. These two circuits are, however, operated in different modes of operation by means of signals S1, S2 derived from a mode control circuit 43. The signals from the circuits 44 and 46 are then fed to an adder 48 in which the two signals are added. The signal from the adder 48 is then applied to a pulse generator 50 to which a dither signal is also fed from a dither signal generator 52. The command signal, which is in the form of pulses, is fed to the valves 14 and 16, thereby to control the "on" and "off" operation thereof.

In FIGS. 1 and 2, the electronic closed loop air-fuel ratio control system is illustrated together with a carburetor, however, it should be noted that the system is also applicable to a fuel injection device.

Figure 3:
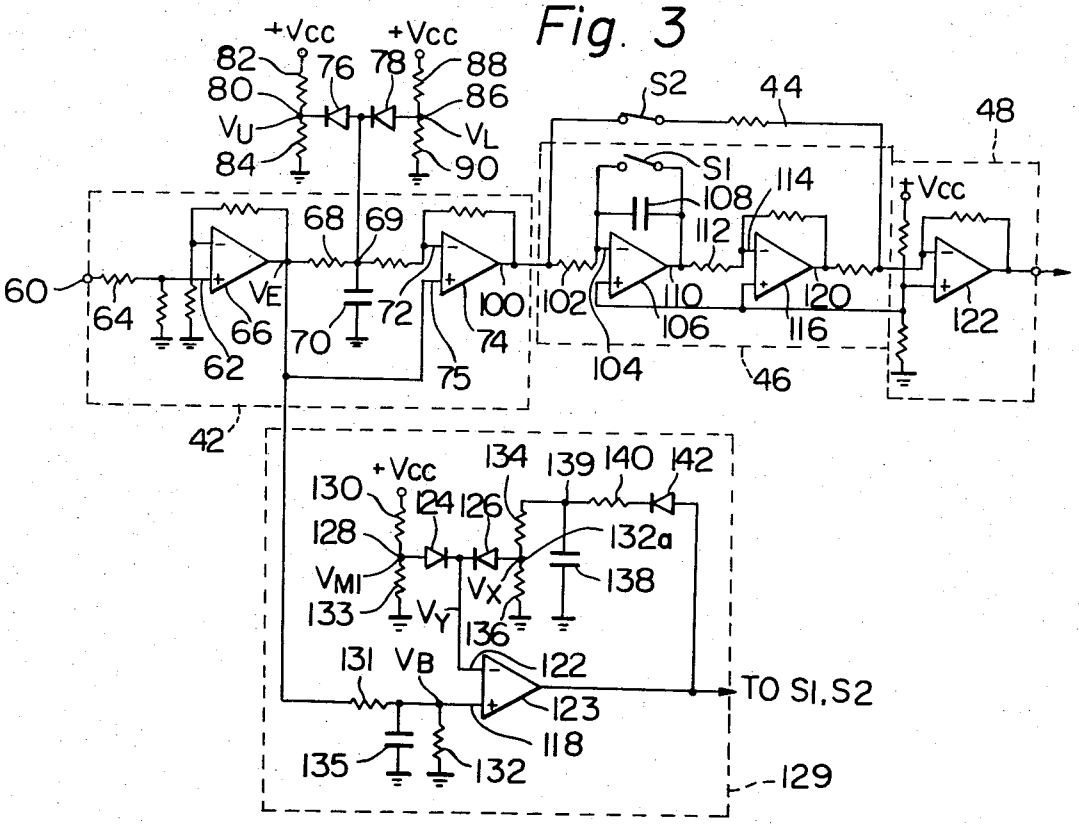
FIG. 3 is a line diagram of the first preferred embodiment of the present invention.

Reference is now made to FIG. 3, which illustrates the first preferred embodiment of the present invention. The signal from the exhaust gas sensor 2 is applied to the difference detecting circuit 42, more specifically, to a non-inverting terminal 62 of an amplifier 66 through a terminal 60 and a resistor 64, being amplified therein. The output of the amplifier 66 is then fed to an integrator consisting of a resistor 68 and a capacitor 70. A junction 69 between the resistor 68 and the capacitor 70 is connected to an inverting terminal 72 of a differential amplifier 74. A non-inverting terminal 75 is directly connected to the output terminal (no numeral) of the amplifier 66. The differential amplifier 74 produces an output indicative of the difference between the magnitudes of the two input signals. It is understood that, since the reference voltage corresponds to a voltage appearing at the junction 69, it changes depending upon the magnitude of the output of the exhaust gas sensor 2. Therefore, the output of the differential amplifier 74 does not change undesirably over a wide range. Meanwhile, the junction 69 is connected to the anode of a diode 76 and the cathode of a diode 78. The cathode of the diode 76 is connected to a junction 80 between resistors 82 and 84, receiving a constant voltage $V_U$ which determines an upper critical value of the reference voltage. On the other hand, the anode of the diode 78 is connected to a junction 86 between resistors 88 and 90, receiving a constant voltage $V_L$ which in turn determines a lower critical value of the reference voltage. Thus, the reference voltage appearing at the junction 69 is controlled in such a manner as to be within a predetermined range defined by the two constant voltages $V_U$ and $V_L$. The output terminal 100 of the amplifier 74 is connected through a resistor 102 to an inverting input terminal 104 of an operational amplifier 106 across which a capacitor 108 is connected. The amplifier 106, the capacitor 108, and the resistor 102 form an integrator. As shown, a switch S1, which is provided across the capacitor 108, normally remains open for feedback control but closes in response to a signal from a comparator 123 for ceasing the feedback control. The output terminal 110 of the amplifier 106 is connected through a resistor 112 to an inverting input terminal 114 of an operational amplifier 116. The amplifier 116 is for inverting the phase of the output of the integrator consisting of the amplifier 106 and the capacitor 108. Another switch S2, which is connected in series with a resistor corresponding to the proportional element 44, is provided in parallel with the integral circuit 46. The switch S2 normally remains closed for the feedback control, but, opens in response to the signal from the comparator 123 ceasing the feedback control together with the closing of the switch S1. The output terminal 120 of the amplifier 116 is connected to an inverting input terminal (no numeral) of an operational amplifier 122 of the adder 48.

As shown in FIG. 3, the difference circuit 42 is connected to a mode control circuit 129 which is a specific embodiment of the mode control circuit 43 of FIG. 2. In particular, the output ($V_E$) of the amplifier 66 is fed to an averaging circuit, which consists of resistors 131 and 132 and a capacitor 135, and which feeds a mean value $V_B$ of the received voltage $V_E$ to an non-inverting input terminal 118 of the comparator 123. The comparator 123 then compares the voltage $V_B$ with a reference voltage $V_Y$ which is applied to the comparator 123 through its inverting input terminal 122. As is well known in the art, the comparator 123 produces a higher voltage when the voltage $V_B$ is higher than the reference voltage $V_Y$, otherwise, producing a lower voltage.

The higher voltage from the comparator 123 opens the switch S1 and closes the switch S2, thereby to initiate the feedback control. The lower voltage from the comparator 123, on the contrary, closes the switch S1 and opens the switch S2, terminating the feedback control. The terminal 122 is connected to the cathodes of diodes 124 and 126. The anode of the diode 124 is connected to a junction 28 between resistors 130 and 133, receiving a constant voltage $V_{M1}$. On the other hand, the anode of the diode 126 is connected to a junction 132*a* between resistors 134 and 136, receiving a voltage $V_x$ which is determined by a voltage at a junction 139 between a capacitor 138 and a resistor 140. The voltage $V_{M1}$ should be less than the maximum of the voltage $V_x$, determining the starting of the feedback control, while, the maximum value of the voltage $V_x$ determines the termination of the feedback control, as will be described below in detail.

With this arrangement, when starting the engine, the constant voltage $V_{M1}$ is higher than the voltage $V_x$, so that the voltage $V_{M1}$ is applied to the terminal 122 of the comparator 123 as the reference voltage $V_x$. On the other hand, the output of the sensor 2 is considerably low upon cold engine start, so that the voltage $V_B$ is less than the voltage $V_Y$. This means that the comparator 123 produces the lower voltage therefrom, so that the switch S1 is closed and the switch S2 is open. Thereafter, as the engine is warmed up, the voltage $V_B$ gradually increases to finally exceed the reference voltage $V_Y$ which corresponds to the constant voltage $V_{M1}$, then, the comparator 123 in turn produces the higher voltage therefrom. This higher voltage opens the switch S1 and closes the switch S2, to initiate the feedback control. The higher voltage from the comparator 123 is also applied, through a diode 142 and the resistor 140, to the capacitor 138. The voltage at the junction 139 therefore rises up to the higher voltage after a predetermined time duration while increasing the voltage $V_x$ up to its maximum voltage $V_{M2}$. As a result, the reference voltage $V_y$ is changed to the voltage $V_x$ when the voltage $V_x$ exceeds the constant voltage $V_{M1}$. Under this condition, if stopping the vehicle and idling, the output of the exhaust gas sensor 2 gradually falls with decreasing of the engine temperature, and when the voltage $V_B$ falls finally below the reference voltage $V_Y$, the comparator 123 in turn produces the lower voltage, closing the switch S1 and opening the switch S2 for stopping the feedback control. On the other hand, the voltage at the junction 139 starts falling to the lower voltage of the comparator 123. Therefore, the reference voltage $V_Y$ is changed to be the voltage $V_{M1}$.

Thus, in accordance with the first preferred embodiment, the reference voltage $V_Y$ is changed in order to start and terminate the feedback control of the system at different magnitudes of the output of the exhaust gas sensor 2.

In the above, the purpose of the integration circuit, being provided between the amplifier 66 and the differential amplifier 74, is to compensate excessive deviation of the output of the sensor 2 resulting from a low ambient temperature or deterioration of the sensor 2 with a lapse of time.

Figure 4:
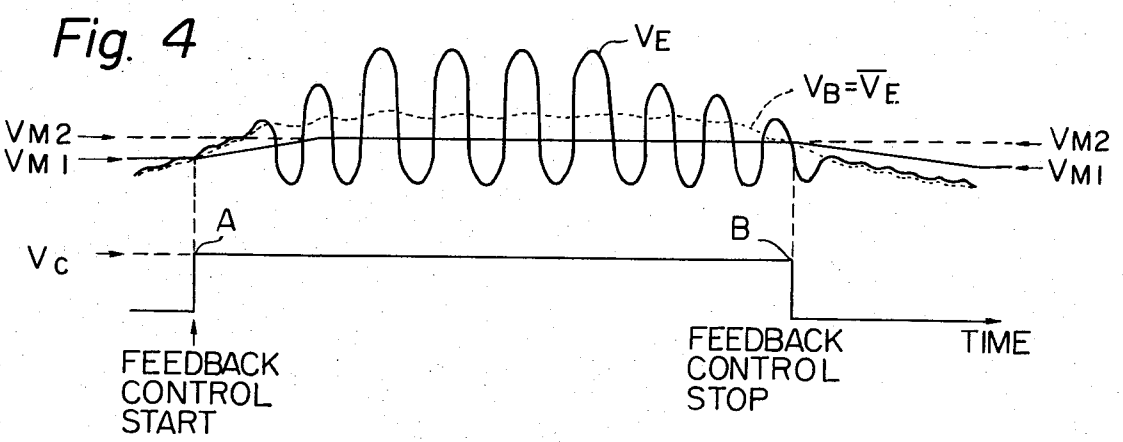
FIG. 4 is a graph showing the operation manner of the embodiment of FIG. 3.

Reference is now made to FIG. 4, which is a graph showing the operation manner of the circuit of FIG. 3, wherein reference character $V_C$ denotes the higher voltage from the comparator 123. The control system in question starts the feedback control at a point "A" because the voltage $V_B$ exceeds the reference voltage $V_Y$ which is, at this time, equal to the voltage $V_{M1}$. Then, the reference voltage $V_Y$ gradually rises up to the voltage $V_{M2}$ according to a time constant determined by the resistor 140 and the capacitor 138. Following, when the voltage $V_B$ falls at a point "B" below the reference voltage $V_Y$ which is equal to $V_{M2}$, the feedback control is terminated in that the comparator 123 produces the lower voltage as previously referred to.

Figure 5:
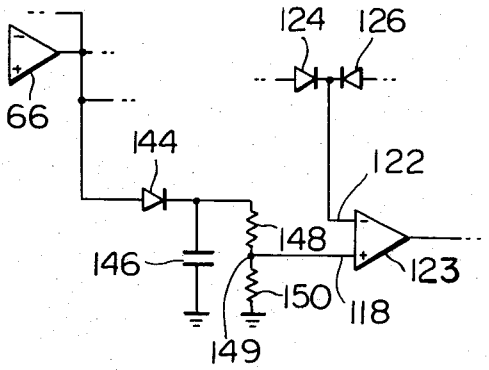
FIG. 5 is a modification of the first preferred embodiment.

Referring to FIG. 5, which is a modification of the circuit of FIG. 3. The resistors 131, 132 and the capacitor 135 of FIG. 3 are replaced by a diode 144, a capacitor 146, and resistors 148, 150 in order to apply a voltage $V_P$ appearing at a junction 149 to the terminal 118 of the comparator 123. The voltage $V_P$ is, for example, equal to half of the maximum value of $V_E$.

Figure 6:
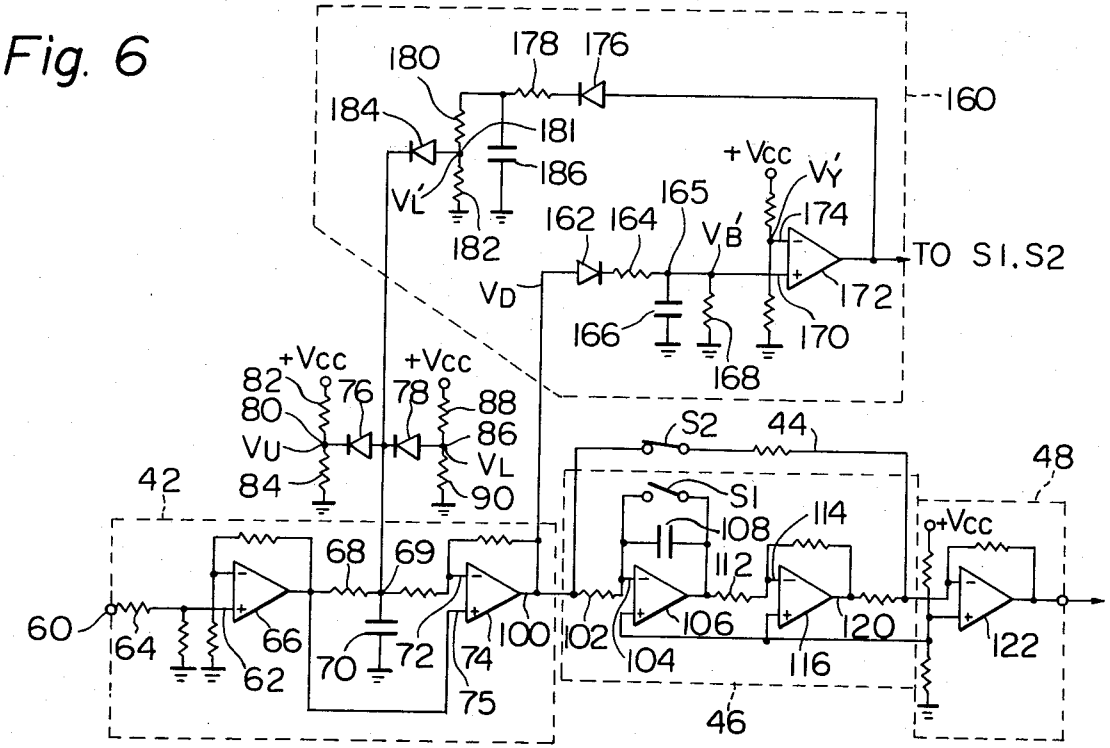
FIG. 6 is a line diagram of the second preferred embodiment of the present invention.

FIG. 6 illustrates a second preferred embodiment of the present invention. The difference between the circuit configurations of FIGS. 3 and 6 is that mode control circuit 129 of the former is substituted by a mode control circuit 160. As shown, the output terminal 100 of the differential amplifier 74 is connected to an averaging circuit consisting of a diode 162, resistors 164, 168, and a capacitor 166. A voltage appearing at a junction 165, which is equal to a mean value $V_B'$ of the voltage $V_D$ from the amplifier 74, is fed to a non-inverting terminal 170 of a comparator 172. The comparator 172 receives a constant voltage $V_Y'$ at its inverting input terminal 174, comparing the same with the voltage $V_B'$ to produce a higher voltage when $V_B'$ is above $V_Y'$, and otherwise produces a lower voltage therefrom. As previously referred to in connection with the circuit of FIG. 3, the higher voltage opens the switch S1 and closes the switch S2 for initiating the feedback control, and on the other hand, the lower voltage closes the switch S1 and opens the switch S2 for terminating the feedback control. The output of the comparator 172 is fed to a charging and discharging circuit consisting of diodes 176, 184, resistors 178, 180, 182, and a capacitor 186. A voltage $V_L'$ at a junction 181 is supplied to the junction 69 only when $V_L'$ is above $V_L$.

Let us now consider the operation of the circuit of FIG. 6, when starting a cold engine, the voltage $V_D$ from the differential amplifier 74 is considerably low, and so is the voltage $V_B'$. As a consequence, the comparator 172 produces the lower voltage in that, under such a condition, the voltage $V_B'$ is below $V_Y'$, resulting in the fact that the switches S1 and S2 remain closed and open, respectively. This means that the feedback control is not yet carried out. As the engine is warmed up, the voltage $V_B'$ gradually increases to finally exceed the reference voltage $V_Y'$, under which condition the comparator 172 produces the higher voltage therefrom. This higher voltage opens the switch S1 and on the other hand closes the switch S2, thereby to initiate the feedback control. The higher voltage from the comparator 172 is also applied, through the diode 176 and the resistor 178, to the capacitor 186. The voltage at the junction 181 therefore rises up to the higher voltage after a predetermined time duration while rising the voltage $V_L'$ to its maximum which is denoted by $V_L''$. As a result, the lower critical voltage $V_L$ is changed to $V_L'$ when the latter exceeds the former. Under this condition, if the vehicle is stopped with the motor idling, the output of the exhaust gas sensor 2 gradually falls with falling of the engine temperature. Accordingly, the mean value $V_B'$ of the voltage $V_D$ gradually falls since the lower critical voltage is now $V_L''$, and finally, the voltage $V_B'$ becomes less than $V_Y'$. This means that the comparator 172 produces the lower voltage, closing the switch S1 and opening the switch S2 for terminating the feedback control. It is understood that, the output voltage of the exhaust gas sensor 2, at which the feedback control is terminated, is higher than that at start.

In the above, the time constant of the integrator consisting of the resistor 178 and the capacitor 186 is larger than that of the integrator consisting of the resistor 68 and the capacitor 70, and also larger than that of the integrator consisting of the resistor 164 and the capacitor 166.

It is apparent from the foregoing that, according to the present invention, an air-fuel mixture ratio is finely controlled by starting and terminating the feedback control of the system at different levels of the output voltage of the exhaust gas sensor.

What is claimed is:

1. A mixture control system for controlling the air-fuel mixture ratio of an internal combustion engine for operation in an open and closed loop mode of operation comprising:

(a) an exhaust gas sensor for generating an output voltage signal representing the concentration of a predetermined constituent gas emitted from aid internal combustion engine, said exhaust gas sensor generating different output voltage signals as a function of temperature, (b) command signal generating means for generating a command signal in response to said sensor output voltage signals, said command signal generating means operative for controlling said air-fuel mixture ratio and comprising:

(i) means for generating a control signal in response to the sensor output voltage signals, said control signal representative of sensed gas concentration, (ii) comparator means, having a first input terminal biased at a variable reference voltage and a second input terminal responsive to said control signal, for generating a closed-loop mode enabling signal to permit said mixture control system to operate in a closed loop mode of operation when said control signal is above said variable reference voltage and a closed loop mode disabling signal to permit said mixture control system to operate in an open loop mode of operation when said control signal is below said variable reference voltage, and (iii) variable voltage reference setting means, responsive to said closed loop mode enabling signal, for varying said variable reference voltage from a first reference voltage corresponding to a relatively low temperature of said exhaust gas sensor to a second reference voltage corresponding to a relatively higher temperature of said exhaust gas sensor and responsive to said closed loop mode disabling signal for varying said variable reference voltage from said second to said first reference voltages.

2. A mixture control system as claimed in claim 1, further comprising means for generating a signal representative of an average value of the output signals from said exhaust gas sensor, said average value representative signal being coupled to said second input terminal of said comparator means as said control signal.

3. A mixture control system as claimed in claim 1, wherein said variable reference setting means includes means for gradually varying said variable reference voltage.

4. A mixture control system as claimed in claim 1, wherein said variable reference setting means comprises a DC voltage source providing said first reference voltage, a first diode for coupling said first reference voltage to said first input terminal of said comparator means, an integrating circuit connected to the output of said comparator means to develop an integrated voltage, and a second diode for coupling said intergrated volage to said first input terminal of said comparator means.

5. A mixture control system as claimed in claim 1, wherein the output signal from said comparator means is connected through said variable reference setting means to said first input terminal of said comparator means in a closed loop circuit.

6. A mixture control system as claimed in claim 1, wherein said comparator means comprises a differential amplifier having a one input terminal connected to be responsive to said control signals and another input terminal connected to be responsive to said variable reference voltage of said setting means for deriving a signal representative of the deviation of said control signal from said variable reference voltage, and a comparator having a first input terminal connected to the output of said differential amplifier and a second input terminal connected to be responsive to a reference voltage of constant value for generating an output signal having a first and a second voltage level in response to said output of said differential amplifier being above or below said constant value reference voltage, respectively, the output signal from said comparator being connected to said variable reference setting means to vary said variable reference voltage from said first reference voltage to said second reference voltage in response to said output signal of said comparator having said first voltage level and to vary said variable reference voltage from said second to said first reference voltage in response to said output signal of said comparator having said second voltage level.

7. A mixture control system as claimed in claim 6 further comprising a resettable integral controller connected to the output of said differential amplifier for generating an integration signal representing the integration of said deviation representative signal with respect to time, said integration signal being said command signal for controlling said air-fuel ratio, said controller being responsive to said enabling signal to operate same as an integrator for said closed loop mode of operation and responsive to said disabling signal to operate as an amplifier for said open loop mode of operation.

8. A mixture control system as claimed in claim 7 wherein said output singal of said comparator is said enabling and disabling signal.

9. A mixture control system as claimed in claim 7, wherein said variable reference setting means comprises an averaging circuit connected at the input of said another input terminal of said differential amplifier for averaging said control signals applied thereto, a DC voltage source providing said first reference voltage, a first diode for coupling said first reference voltage to said another input terminal of said differential amplifier, an integrating circuit connected to the output of said comparator to develop an integrated voltage of the comparator output voltage and a second diode for coupling said integrated voltage to said another input terminal of said differential amplifier.

10. Apparatus for controlling the air-fuel mixture ratio of an internal combustion engine for operation in an open loop mode of operation and closed loop mode of operation, comprising.

(a) exhaust gas sensor means for generating a sensor signal representative of the concentration of at least one gas constituent of said exhaust gas of said internal combustion engine, said sensor signal having temperature dependent voltage levels, (b) comparator means having a first input terminal biased at a variable reference voltage and a second input signal responsive to said sensor signal for generating a closed loop mode enabling signal to permit said apparatus to operate in a closed loop mode of operation when said sensor signal is above said variable reference voltage and a closed loop mode disabling signal to permit said apparatus to operate in an open loop mode of operation when said sensor signal is below said variable reference voltage, and (c) variable voltage reference setting means responsive to said closed loop mode enabling signal for varying said variable reference voltage from a first reference voltage corresponding to a relatively low temperature of said exhaust gas sensor to a second reference voltage corresponding to a relatively higher temperature of said exhaust gas sensor and responsive to said closed loop mode disabling signal for varying said variable reference voltage from said second to said first reference voltages.

* * * * *